US005284260A

United States Patent [19]

Caligiuri, Sr.

[11] Patent Number: 5,284,260

[45] Date of Patent: Feb. 8, 1994

[54] METHOD AND MEANS FOR SUPPORTING CLOTHES HANGERS

[76] Inventor: Gerald J. Caligiuri, Sr., 3124 Park Plaza, Des Moines, Iowa 50315

[21] Appl. No.: 980,480

[22] Filed: Nov. 23, 1992

[51] Int. Cl.[5] ..... A47F 5/00

[52] U.S. Cl. ..... 211/86

[58] Field of Search ..... 211/86, 96, 102, 105.5, 211/174, 168; 248/354.1, 161

[56] References Cited

U.S. PATENT DOCUMENTS

| | | | |
|---|---|---|---|
| 445,633 | 2/1891 | Becker | 211/174 X |
| 785,455 | 3/1905 | Vigie . | |
| 949,066 | 2/1910 | Fowler | 211/174 |
| 1,405,287 | 1/1922 | Clifford | 248/161 |
| 1,581,463 | 4/1926 | Moors . | |
| 2,941,669 | 6/1960 | Palay et al. | 211/86 X |
| 2,974,805 | 3/1961 | Brosseau | 211/105.5 |
| 3,435,957 | 4/1969 | Lloyd . | |
| 3,447,488 | 6/1969 | Lehrman . | |
| 3,507,402 | 4/1970 | Barbee . | |
| 3,522,889 | 8/1970 | Himmel . | |
| 3,952,877 | 4/1976 | Kindl | 211/105.5 |
| 3,961,822 | 6/1976 | Daniel | 211/86 X |
| 4,094,414 | 6/1978 | Thiot et al. . | |
| 4,101,036 | 7/1978 | Craig | 211/86 |
| 4,164,288 | 8/1979 | Okazaki . | |
| 4,576,354 | 3/1986 | Blessing, Sr. . | |

FOREIGN PATENT DOCUMENTS

| | | | |
|---|---|---|---|
| 700411 | 12/1953 | United Kingdom | 248/161 |

*Primary Examiner*—Robert W. Gibson, Jr.
*Attorney, Agent, or Firm*—Zarley, McKee, Thomte, Voorhees, & Sease

[57] ABSTRACT

A support for clothes hangers includes an upper tube section telescopically received in the upper end of a lower tube section. A support arm is slidably fitted over the upper tube section and extends perpendicularly with respect thereto. Below the support arm is a locking pin which extends through a diametric bore in the upper tube section. Below the pin is a spring which is compressed between upper and lower stop washers. The lower stop washer engages the upper end of the lower tube section. The upper end of the upper tube section and the lower end of the lower tube section may be compressed together against the bias of the spring so as to fit between the ceiling and floor of a room.

11 Claims, 1 Drawing Sheet

METHOD AND MEANS FOR SUPPORTING CLOTHES HANGERS

BACKGROUND OF THE INVENTION

This invention relates to a method and means for supporting clothes hangers.

Both in the home and in commercial laundries, it is desirable to have a support for hanging clothes hangers as the clothes are being pressed and hung on hangers. It is also desirable to have a device for supporting the hangers which can be quickly and easily assembled and disassembled for use or for storage respectively.

Therefore, a primary object of the present invention is the provision of an improved method and means for supporting clothes hangers.

A further object of the present invention is the provision of apparatus for supporting clothes hangers which includes a vertical post which can be mounted between the floor and ceiling of a room at any desired location.

A further object of the present invention is the provision of an apparatus for supporting clothes hangers which includes a first support arm sufficiently strong to support clothes hangers having clothing hung thereon and a second support member for supporting empty hangers.

A further object of the present invention is the provision of an apparatus for supporting clothes hangers which can be easily adjusted to accommodate rooms having different distances between the floor and ceiling.

A further object of the present invention is the provision of an improved apparatus for supporting clothes hangers which can be disassembled and placed in a small container for storage.

A further object of the present invention is the provision of an improved apparatus for supporting clothes hangers which is economical to manufacture, durable in use, and efficient in operation.

SUMMARY OF THE INVENTION

The foregoing objects are achieved by an apparatus for supporting clothes hangers comprising upper and lower tube sections with the upper tube section being telescopically received within the lower tube section. Before the upper tube section is inserted into the lower tube section, a sleeve of a hanger support is slidably mounted over the upper tube section. The hanger support includes a sleeve slidably mounted over the upper tube section as well as a support arm which extends perpendicularly away from the upper tube section.

The upper tube section includes a plurality of diametric holes extending therethrough, and a pin is inserted through one of those diametric holes below the sleeve of the support arm. Next, an upper stop washer is slipped over the lower end of the first tube section and is pushed upwardly until it abuts against the pin extending through the diametric hole in the upper tube section. An elongated coil spring is then placed over the lower end of the upper tube section below the upper washer and the pin. Finally, a lower stop washer is slipped over the lower end of the upper tube section so that the coil spring is positioned between the upper and lower stop washers.

The lower end of the upper tube section is then telescopically fitted within the upper end of the lower tube section. The lower stop washer engages the upper end of the lower tube section and consequently limits the downward movement of the upper tube section within the lower tube section.

The distance between the upper end of the upper tube section and the lower end of the lower tube section is determined by the particular hole of the upper tube section in which the pin is inserted. Preferably the distance between the upper and lower ends of the telescoped tube sections should be slightly greater than the distance between the floor and the ceiling of the room in which the device is to be mounted. The device can also be mounted between a countertop and the ceiling, between a washer or dryer top and the ceiling, or between a table and the ceiling.

To mount the device within a room, the upper tube section is forced downwardly into the lower tube section against the spring bias provided by the coil spring. The tubes are then permitted to expand with respect to one another in response to the spring force caused by the spring until the upper end of the upper tube section and the lower end of the lower tube section press against the ceiling and floor of the room respectively. This holds the upper and lower tube sections in a vertical position between the ceiling and floor. In this position, the support arm extends horizontally, and one end of the pin also extends horizontally. The protruding end of the pin can be used to support empty hangers, and the support arm can be used to support hangers having clothing thereon.

DESCRIPTION OF THE PREFERRED EMBODIMENT

Figure 1:
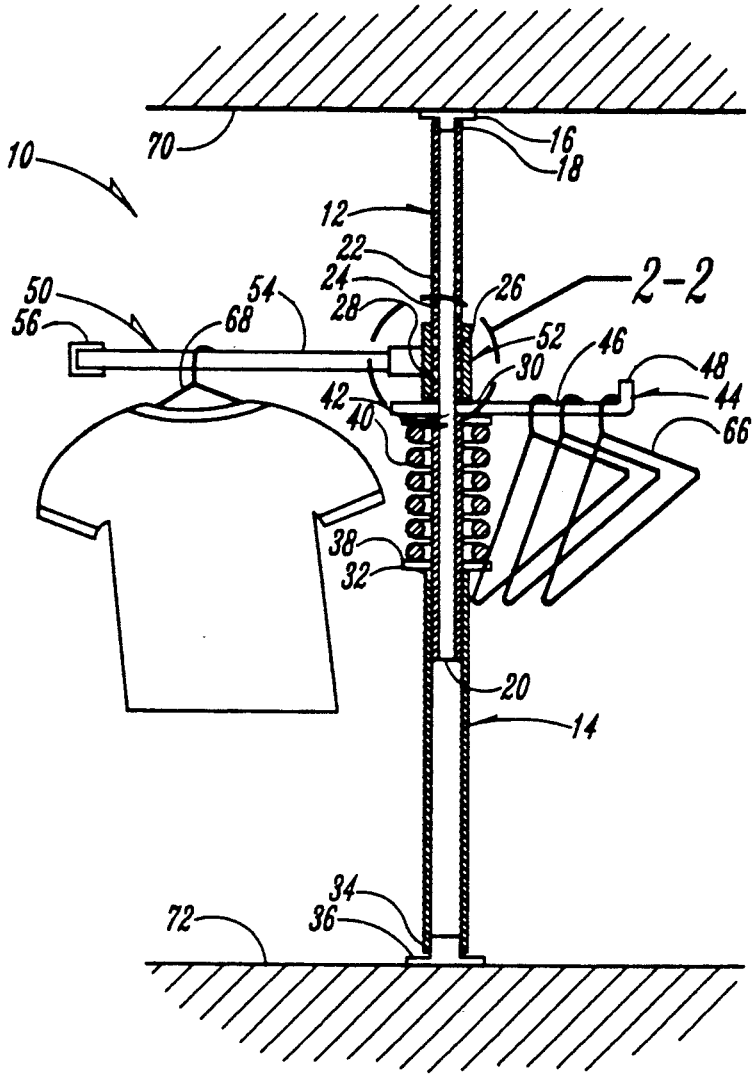
FIG. 1 is a front elevational view of the present invention showing the telescoped tube sections in cross-section.

Referring to the drawings, the numeral 10 generally refers to the support apparatus of the present invention. Apparatus 10 includes an upper tube section 12 and a lower tube section 14.

The upper tube section 12 includes an upper end 18 having an upper pad 16 mounted therein and a lower end 20 which is telescopically received within the upper end 32 of the lower tube section 14. A plurality of vertically spaced diametric bores 22, 24, 26, 28, 30 are provided along the length of upper tube section 12. Only five bores are shown in the drawing for illustrative purposes, but preferably there should be a much larger number of such bores.

Lower tube section 14 includes a lower end 34 having a lower pad 36 mounted thereto.

Figure 3:
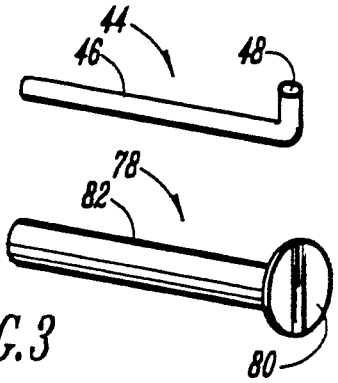
FIG. 3 is a perspective view of two forms of pin which can be used with the present invention.

A bottom stop washer 38 is slidably received over the lower end 20 of upper tube section 12 and is sized to abut against the upper end 32 of lower tube section 14. Mounted over the lower stop washer 38 is a coil spring 40, and mounted above the coil spring 40 is a top stop washer 42. A stop pin 44 includes a shank portion 46 extending through one of the diametric bores 22, 24, 26, 28, 30 of upper tube section 12. In FIG. 1, the shank portion 46 extends through bore 30, but depending upon the desired length required for the assembled first and second tube sections, other bores 22, 24, 26, 28 may be selected. The particular configuration of stop pin 44 can be varied slightly without detracting from the invention. The stop pin 44 shown in FIG. 1 includes a shank portion 46 and a hook or L-shaped portion 48. Referring to FIG. 3, a modified form of the pin 78 may include a shank 82 and a round head 80.

Mounted above pin 44 is a hanger support 50 which comprises a T-shaped sleeve 52 having a support arm 54 extending perpendicularly therefrom. At the outer end of support arm 54 is a plastic or rubber end cover 56. The other end of support arm 54 is fitted within a horizontal socket bore 62 of a horizontal socket 60 which forms a part of T-shaped sleeve 52. The T-shaped sleeve 52 also includes a vertical bore 58 which is slidably mounted over the upper tube section 12.

Figure 2:
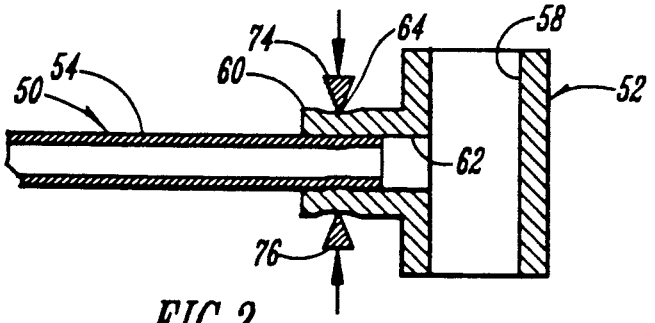
FIG. 2 is an enlarged detailed view taken along line 2—2 of FIG. 1.

The horizontal support arm 54 is secured within the horizontal socket bore 62 of socket 60 by means of a crimp or bead 64 (FIG. 2) which can be provided by conventional crimping elements 74, 76 of a crimping tool.

The shank portion 46 of pin 44 (or the shank portion 82 of the pin 78) may be used to support empty hangers during the clothes pressing process. The support arm 54 is sufficient to support filled hangers 68. The upper tube section 12 and the lower tube section 14 are forced downwardly against the spring bias provided by spring 40 so that they may be fitted between the ceiling 70 and the floor 72. They are then permitted to expand so that the upper pad 16 and the lower pad 36 are pressed against the ceiling 70 and floor 72 respectively.

If the distance between the floor 72 and the ceiling 70 is less than that shown in FIG. 1, the length of the telescoped tube sections can be adjusted by removing pin 44 from the bore 30 and inserting it into one of the other bores 22, 24, 26, 28 so as to achieve the desired length. The distance between the upper pad 16 and the lower pad 36 should normally be slightly greater than the distance between the floor 72 and the ceiling 70 so that the tube sections can be compressed and so that the spring 40 will exert a force causing the upper pad 16 and the lower pad 36 against the ceiling and floor respectively.

After the device has been used, it can be quickly and easily dissembled. All that is required to dissemble the device is to remove the pin 44 and to slide the upper tube section 12 out of the lower tube section 14. The parts then can be stored in a container for later use. When it is desired to reassemble the device, the sleeve 52 of the support arm 50 is slipped over the upper tube section 12. Next the pin 44 is inserted into the appropriate bore 22, 24, 26, 28, 30. The upper stop washer 42, the spring 40, and the washer 38 are slipped over the lower end of upper tube section 12. Finally, the lower end 20 of the upper tube section 12 is telescopically inserted into the upper end 32 of the lower tube section 14. The device is then ready for mounting between the ceiling and floor 70, 72 respectively.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

I claim:

1. Apparatus for supporting clothes hangers comprising:

first and second tube sections each having first and second opposite ends, at least said second tube section having a longitudinal bore extending therethrough;

said first tube section being telescopically received within said second tube section for longitudinal telescoping movement therein from a retracted position wherein said first tube section protrudes a first distance from said first end of said second tube section to a plurality of extended positions wherein said first tube protrudes from said first end of said second tube a plurality of distances respectively, each of which is greater than said first distance;

said first tube section having a plurality of radially extending bores therein, said plurality of bores being axially spaced from one another along the length of said first tube section;

first stop means surrounding said first tube section and engaging said first end of said second tube section;

second stop means comprising pin means fitted within one of said bores in said first tube section;

an elongated axially compressible coil spring surrounding said first tube section between said first and second stop means whereby said spring means is axially confined between said first and second stop means for yieldably holding said first tube section in one of said plurality of extended positions and said first tube section is yieldably movable toward said retracted position against the bias of said compressible spring means;

a support member comprising a sleeve slidable on said first tube section, and a support arm connected to said sleeve and extending perpendicularly to said first tube section.

2. Apparatus according to claim 1 wherein said pin means is positioned between said sleeve of said support member and said coil spring.

3. Apparatus according to claim 1 wherein said first end of said first tube section is within said second tube section and said second end of said first tube section includes first pad means for engaging a ceiling of a room and said second end of said second tube section includes second pad means for engaging a floor of said room.

4. Apparatus according to claim 1 wherein said pin means extends radially outwardly from said first tube section.

5. Apparatus according to claim 4 wherein said spring is in compression when said first tube section is in said one of said plurality of positions whereby said spring means exerts an axial yieldable force on said pin means to hold said pin means within said bore of said first tube section and to hold said pin against rotation within said bore.

6. Apparatus according to claim 1 wherein said sleeve includes a socket means, said support arm having a first end fitted within said socket means.

7. Apparatus according to claim 6 and further comprising securing means retentively holding said first end of said support arm within said socket means.

8. Apparatus according to claim 7 wherein said securing means comprising at least one crimp in said socket means for retentively engaging said first end of said support arm.

9. Apparatus according to claim 1 wherein said first stop means comprises a first washer slidably mounted over said first tube section and abutting against said first end of said second tube section.

10. Apparatus according to claim 9 wherein said second stop means further comprises a second washer slidably mounted on said first tube section between said pin means and said coil spring.

11. A method for supporting clothes hangers in a room having a ceiling and a floor spaced apart a first distance, said method comprising:

taking first and second tube sections each having upper and lower ends;

slipping a sleeve of a support member over said lower end of said first tube section, said support member having a support arm attached to said sleeve and extending perpendicularly to said first tube section;

inserting a pin through a diametric hole in said first tube section;

placing an elongated coil in surrounding relation over said lower end of said first tube section below said pin;

placing a first stop washer over said lower end of said first tube section below said coil spring;

inserting said lower end of said first tube section into said upper end of said second tube section whereby said first stop washer will engage said upper end of said second tube section and said spring will be embraced between said pin and said first stop washer to limit downward telescoping movement of said first tube section into said second tube section, whereby said upper end of said first tube section and said lower end of said second tube section are spaced apart a second distance greater than said first distance between said ceiling and said floor;

forcing said first tube section further down into said second tube section against the bias of said spring until said upper end of said first tube section and said lower end of said second tube section are spaced apart a third distance less than said first distance;

permitting said spring to expand said first and second tube sections apart until said upper end of said first tube section and said lower end of said second tube section are pressed against said ceiling and floor respectively.

* * * * *